US005624055A

United States Patent [19]

Clanet et al.

[11] Patent Number: 5,624,055

[45] Date of Patent: Apr. 29, 1997

[54] DISPENSER DEVICE WITH SEALED CLOSURE FOR THE CONTENTS OF A RECEPTACLE THAT IS PRESSURIZED OR THAT HAS A PUMP

[76] Inventors: Frank Clanet; Anne Dellerm, both of 4 bis, Sentier des Voisinoux, 92190 Meudon, France

[21] Appl. No.: 397,493

[22] Filed: Mar. 2, 1995

[30] Foreign Application Priority Data

Mar. 3, 1994 [FR] France ..... 94 02447

[51] Int. Cl.[6] ..... B65D 83/00

[52] U.S. Cl. ..... 222/135; 222/380; 222/402.12; 222/402.13; 222/189.06; 222/321.8

[58] Field of Search ..... 222/135, 137, 222/380, 387, 505, 509, 402.12, 402.13, 189.06, 189.11, 321.8; 239/575, 590

[56] References Cited

U.S. PATENT DOCUMENTS

| | | | |
|---|---|---|---|
| 3,154,224 | 10/1964 | Wakeman | 222/402.12 |
| 3,469,746 | 9/1969 | Melocchi | 222/402.13 X |
| 3,506,165 | 4/1970 | Beard . | |
| 3,584,789 | 6/1971 | Traynor . | |
| 3,760,986 | 9/1973 | Castner et al. | 222/137 |
| 4,061,250 | 12/1977 | Tada | 222/321.8 |
| 4,122,978 | 10/1978 | Guimond et al. | 239/575 X |
| 4,187,963 | 2/1980 | Mascia | 222/402.13 |
| 4,793,522 | 12/1988 | Corsette | 222/387 X |
| 4,880,143 | 11/1989 | Murray et al. | 222/135 |
| 4,949,874 | 8/1990 | Fiedler et al. | 222/135 |
| 5,429,275 | 7/1995 | Katz | 222/380 X |
| 5,433,343 | 7/1995 | Meshberg | 222/43 X |

FOREIGN PATENT DOCUMENTS

| | | | |
|---|---|---|---|
| 376079 | 7/1990 | European Pat. Off. | 222/387 |
| 3126835 | 9/1972 | France . | |
| 93/01100 | 1/1993 | WIPO . | |

*Primary Examiner*—Kevin P. Shaver

*Attorney, Agent, or Firm*—Burns, Doane, Swecker & Mathis, L.L.P.

[57] ABSTRACT

A device for dispensing the contents of a receptacle that is pressurized or that has a pump, includes a dispensing head forming a discharge orifice. A shutter is slidable in the head for opening or closing the outlet orifice. The shutter is slidably mounted in a bore of the dispensing head which communicates with the inside of the receptacle. The device also includes a control member for actuating the shutter to open the outlet orifice and simultaneously operating an actuating member (e.g., a valve or pump) of the receptacle for supplying the contents to the bore. The control member is pivotable about an axis and includes portions operably connected to the dispensing head and shutter. The actuating member is spring-biased to a rest position. Upon returning to its rest position, the actuating member displaces the dispensing head and control member to their rest positions.

20 Claims, 3 Drawing Sheets

FIG. 1
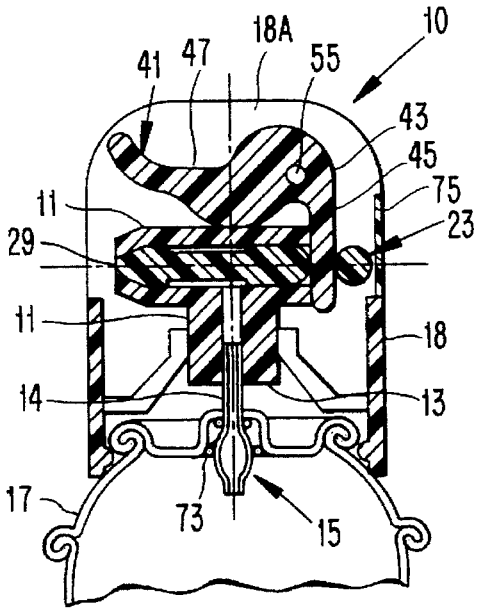
FIG. 2
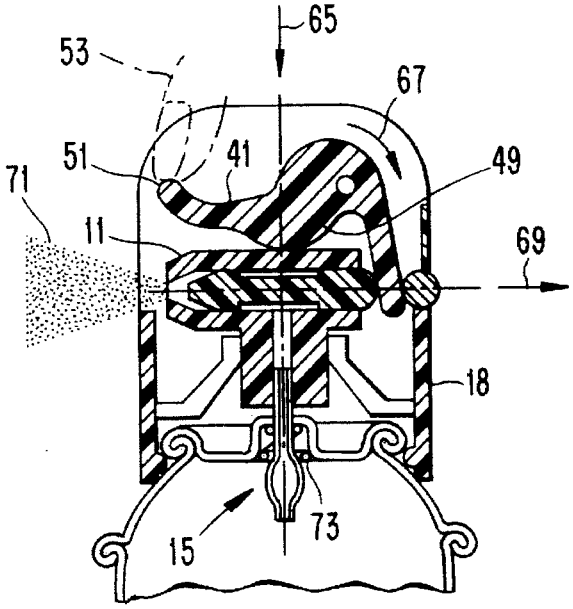
FIG. 4
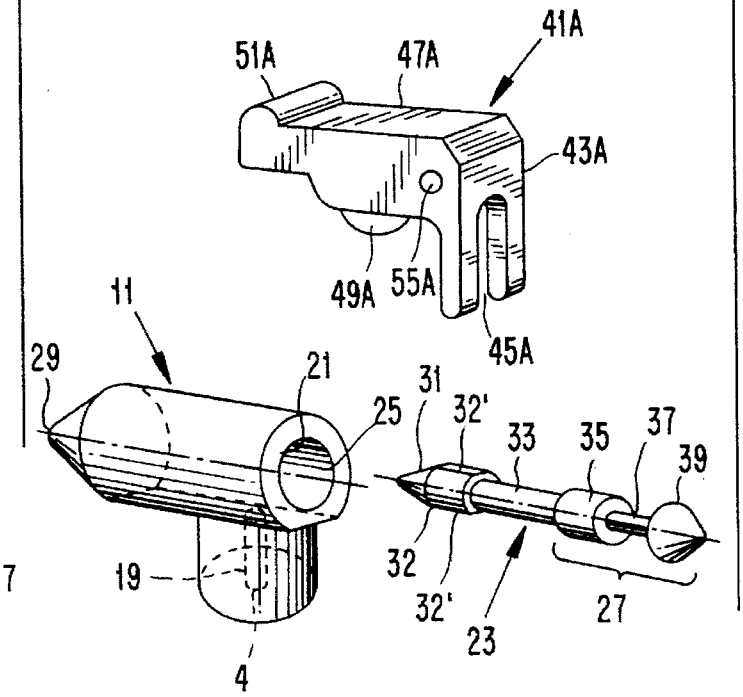
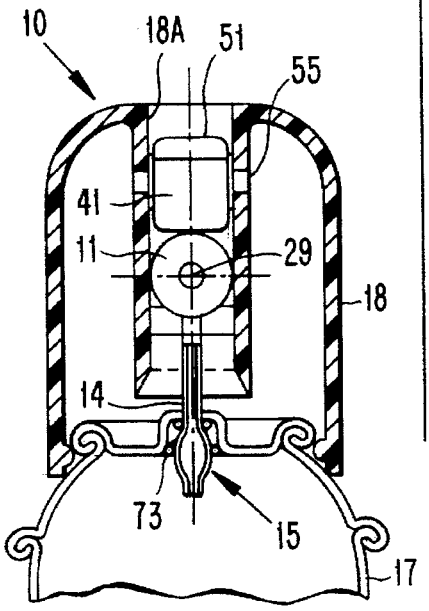
FIG. 3

DISPENSER DEVICE WITH SEALED CLOSURE FOR THE CONTENTS OF A RECEPTACLE THAT IS PRESSURIZED OR THAT HAS A PUMP

BACKGROUND OF THE INVENTION

The invention relates to a dispenser device with a sealed closure for the contents of a receptacle, wherein the contents can be pressurized, or a pump employed to discharge the contents.

It is known that the dispenser device for the contents of a receptacle that is pressurized (or an "aerosol"), and likewise the dispenser device for a receptacle that has a pump, generally suffers from the drawback of not protecting from ambient air a residual volume of substance to be dispensed that remains in the valve or the dispenser after the device has been actuated. As a result, with some of the substances that are to be dispensed, drying or polymerization takes place, thereby clogging the valve, the pump, and/or the dispenser and making it unusable, so that the substance remaining in the receptacle cannot be dispensed. With certain substances, such as medicines or the like, the above drawback of known devices can also have the consequence of spoiling the quality and/or compromising the sterility of the residual substance that stagnates in contact with air in the valve, the pump, and/or the dispenser, such that even if the user takes the precaution of discarding the initial fraction on each expulsion, the substance in the receptacle has been in contact with a spoiled fraction and may be contaminated, thereby making it unsuitable for the use for which it is intended.

In an attempt to mitigate this drawback, proposals have already been made for top-closing aerosol valve devices, see for example U.S. Pat. No. 3,506,165 or French Patent 2,126,835. The latter document, in particular, discloses an aerosol dispenser valve in which a plug slidably mounted in a bore can be displaced by means of a push-button against the action of a spring so as to uncover an outlet opening for the substance contained in the aerosol. The presence of the spring and the fact that the plug is associated with a valve rod and with a lip seal mean that the assembly comprises too many individual parts, thereby increasing the cost of manufacture and of assembly for devices that must necessarily be cheap.

In addition, the valve of French Patent 2,126,835 is fitted directly onto receptacles under pressure. It is therefore unsuitable for fitting to a standard aerosol that already has a valve.

Consequently, the problem is to provide a device for dispensing the contents of a top-closing receptacle that is pressurized or that has a pump, the device being simpler in structure than known devices and being independent of the valve and/or the pump.

OBJECTS AND SUMMARY OF THE INVENTION

A general object of the invention is to provide a solution to this problem.

Another object of the invention is to provide such a device that requires no modification of existing packaging lines in order to be installed on the receptacle that is to receive it.

Another object of the invention is to provide such a device that is well adapted to dispensing substances having different viscosity characteristics, and in particular that is capable of dispensing semi-solids or gaseous aerosols or sprays of fine liquid droplets.

Another object of the invention is to provide such a device which makes it simple to ensure that the receptacle containing the substance to be dispensed is tamper-proof.

Another object of the present invention is to provide a device that includes a cap whose shape and/or colors can be chosen to make it easy for consumers to distinguish the product from a competitor's product.

Finally, an object of the invention is to provide such a device that is suitable for use in mixing a plurality of substances for being dispensed simultaneously, and which by construction also includes a protective cap that is integrated therewith.

A device for dispensing the contents of a receptacle that is pressurized or of a receptacle that has a pump, includes a plug for shutting the outlet orifice of the device, the plug being slidably mounted in a bore suitable for communicating with the inside of the receptacle, and the device also includes a member for actuating said plug. According to the invention, the device further includes means for connection to at least one aerosol valve or pump of a receptacle, a cap suitable for being applied and assembled either to the valve cup(s) of one or more aerosols or to the pump(s) of one or more receptacles having pumps, the shutter actuator member being pivotally mounted on said cap which it closes in part.

According to another characteristic of the invention, a tampering indicator is associated with the cap and with the actuator member so as to prevent the actuator member being operated until the indicator has been removed for a first use thereof.

The present invention mainly provides a device for dispensing the substance contained in a receptacle that has a pump or that is pressurized and has a valve, the device comprising a mechanical control member for controlling the valve or the pump, and a rigid duct having a first end provided with means for connection to the valve or to the pump and a second end forming a dispensing orifice for the substance, the device further comprising a shutter for shutting the second end of the duct which forms the dispensing orifice, and wherein the mechanical control member operates simultaneously or substantially simultaneously and during substantially the same period of time to open the dispensing orifice and to actuate the valve or the pump, and wherein, after the substance has been dispensed, the mechanical control member for controlling the valve or the pump ensures that the orifice for dispensing the substance is closed under drive from a return element of the valve or of the pump.

The invention also provides a device wherein the rigid duct includes a chamber having a narrowed portion that is preferably frusto-conical, the end thereof forming the dispensing orifice, and wherein the shutter comprises a pin slidably mounted inside the chamber to move in translation between a first condition in which the pin closes the dispensing orifice and a second condition in which the pin withdraws into the chamber, thereby disengaging the dispensing orifice.

The invention also provides a device wherein the rigid duct is bent, wherein the pin includes a shutter tip at a first end and a neck at an opposite second end that extends outside the chamber, wherein the mechanical control member is S-shaped or L-shaped and is mounted to pivot about an axis perpendicular to the plane of the S-shape or of the L-shape, a first limb of the S-shape or the L-shape including a fork that engages around the neck of the pin, a second limb of the S-shape or of the L-shape forming a lever and including a projection on a face that faces the duct, the projection slidably bearing against the duct, the second limb also having an element on its opposite face and preferably at the end thereof for the purpose of receiving the finger of the user.

The invention also provides a device including a stand forming a cap having assembly means for engaging the receptacle and including a pivotal support for the mechanical control member.

The invention also provides a device including a breakable element for tamper-proofing the receptacle by preventing the pin moving in translation, thereby preventing any substance being dispensed, and having a second condition, once broken, enabling the pin to move in translation and thereby enabling substance to be dispensed.

The invention also provides a device wherein the end of the duct that forms the orifice for dispensing the substance includes temporary assembly means, in particular a truncated cone having a small angle at the apex, for receiving a cannula, a filter, or an injection needle that is discardable after use.

The invention also provides a device including a plurality of rigid ducts, each having a respective first end provided with means for connection to a valve or a pump of a respective receptacle, and a respective second end forming an orifice for dispensing substance, and wherein the device has a single mechanical control member for simultaneously controlling all of the valves or pumps and opening all of the shutters of the dispensing orifices, and wherein the dispensing orifices point in substantially the same direction so as to enable the substances from all of the receptacles to be dispensed simultaneously and/or mixed together.

The invention also provides a device wherein the chamber (s) is/are of calibrated volume enabling the substances to be measured out, wherein the mechanical control means for the valve(s) or the pump(s) ensure operation thereof until the chamber(s) is/are filled, after which opening of the shutter(s) ensures that predetermined measured quantity(ies) of the substances is/are dispensed.

The invention also provides a device wherein the mechanical control member includes a lever secured to a cap and pivotal relative to said cap about an axis situated substantially over the dispensing orifice, and wherein said lever is flexible such that during pivoting, bending of the lever causes the dispensing opening to open via a member disposed opposite from the dispensing orifice.

The invention also provides an aerosol including at least one pressurized tank provided with a valve, and including a device of the invention for dispensing substance, in which the first end of each rigid duct is connected to a valve.

The invention also provides packaging for a substance, the packaging comprising at least one tank containing said substance to be dispensed and a pump for dispensing the substance, the packaging further comprising a device of the invention for dispensing substance, in which the first end of each rigid duct is connected to a pump.

BRIEF DESCRIPTION OF THE DRAWINGS

The invention will be well understood from the following description given by way of example and made with reference to the accompanying drawings, in which:

FIG. 1 is a section view through a device of the invention fitted to an aerosol and shown at rest;

FIG. 2 is a view analogous to FIG. 1 showing an aerosol in operation;

FIG. 3 is a view at 90° to FIG. 1;

FIG. 4 is a perspective view showing several essential elements of a particular embodiment of the device of the present invention;

Figure 11:
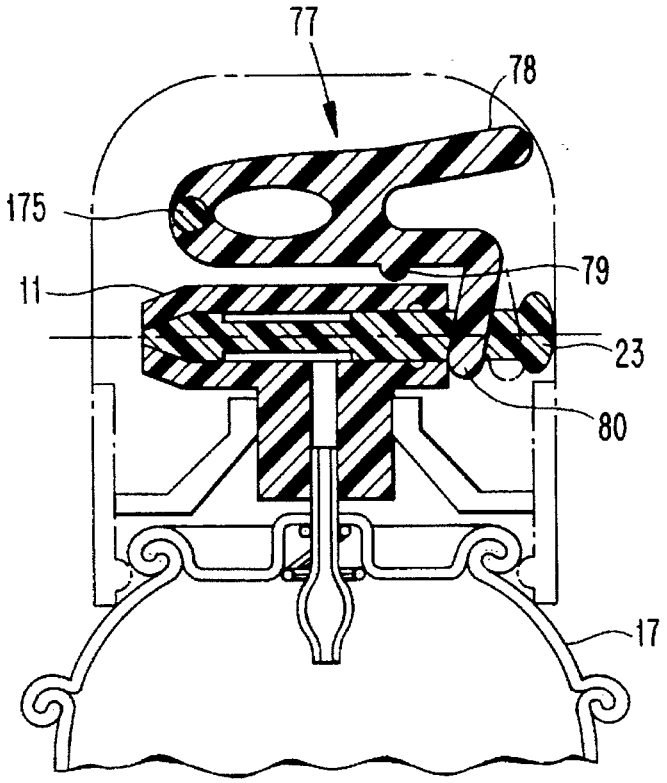
Figure 6:
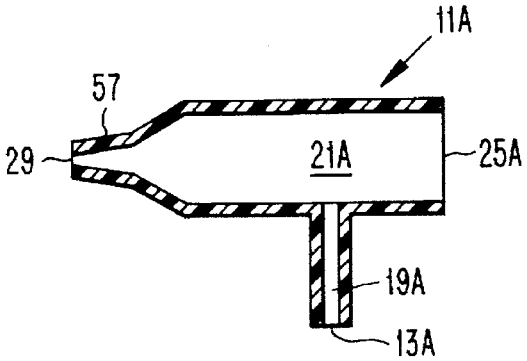
FIG. 6 is a section view of an embodiment of a duct suitable for being implemented in the device of the present invention.
Figure 7:
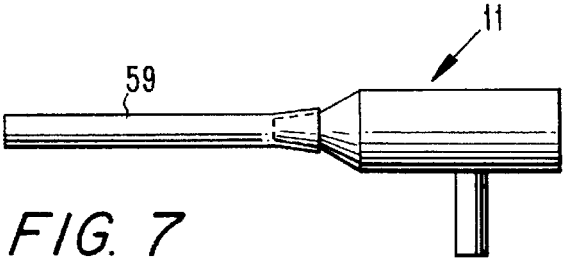
FIG. 7 is a side view of the FIG. 6 duct provided with a removable cannula.
Figure 8:
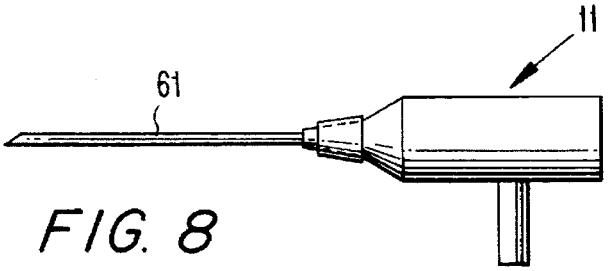
Figure 9:
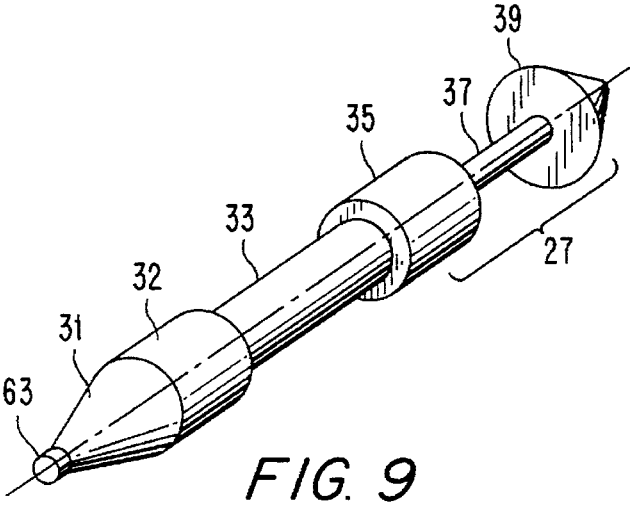
Figure 10:
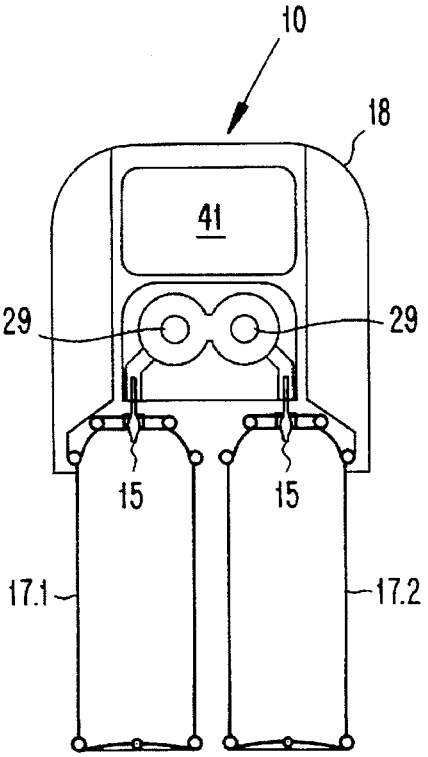

Pig. 8 is a side view of the FIG. 6 duct fitted with a removable needle;

FIG. 9 is a perspective view of a variant embodiment of a shutter suitable for being implemented in the present invention;

FIG. 10 is a view analogous to FIG. 1, but for a device fitted to two aerosols; and FIG. 11 shows a preferred embodiment of the invention.

DETAILED DESCRIPTION OF PREFERRED EMBODIMENTS OF THE INVENTION

In FIGS. 1 to 11, the same references are used to designate the same elements.

Figure 1A:
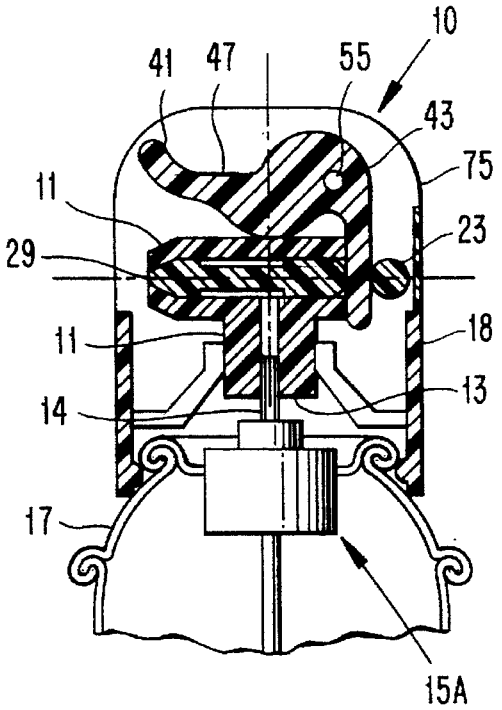
FIG. 1A is a view similar to FIG. 1 of a pump-type dispenser.

Reference is made initially to FIGS. 1 and 2 which show a device of the invention as associated with an aerosol receptacle, it being understood that it is not limited to aerosols insofar as the device is equally applicable to a receptacle having a spray pump, or the like. In the embodiment shown and described, the device 10 comprises a dispensing head in the form of a rigid pipe 11 having a 90° bend, with a first end 13 adapted to be connected to an outlet duct 14 of a conventional actuator member in the form of a spring-biased valve 15 of an aerosol receptacle 17 (i.e., a receptacle containing a substance under pressure). Alternatively, the actuator member could comprise a conventional pump 15A in non-aerosol dispensers as shown schematically in FIG. 1A. The pipe 11 is guided in translation parallel to the axis of the valve 15 by a support member in the form of a cap 18 having a 18A in which the duct 11 is disposed. The cap 18 is mounted to the receptacle by a removable or permanent connection.

A first branch 19 of the pipe 11, shown in the vertical position, opens at its end remote from the end 13 into a conduit in the form of a cylindrical chamber 21 which is shown in a horizontal position and which forms a second branch of the pipe 11 that receives a slidably mounted pin 23 having a retaining member 27 projecting through an end opening 25. An end 29 of the chamber 21 opposite from the opening 25 forms an orifice for dispensing the substance. The pin 23 has a tip 31 that serves to close the dispensing orifice 29, followed by a piston 32, a rod 33 extending along the major fraction of its length inside the chamber 21, a piston 35 that provides sealing at the opening 25, and a neck 37 followed by a terminating ball 39. Advantageously the dimensions, and in particular the diameter in the example shown, of the pistons 32 and 35 correspond to the diameter of the cylindrical wall of the chamber 21, with the piston 32 including upper and lower flats 32', 32' so that the passages are formed between the flats and the wall of chamber 21 to conduct the substance to be dispensed. Alternatively, the piston 32 could be completely cylindrical (see FIG. 9) and of smaller diameter than the chamber 21 to define a passage therebetween.

Figure 5:
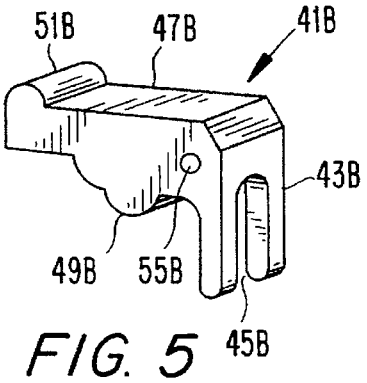
FIG. 5 is a perspective view of a variant embodiment of a mechanical control member suitable for being implemented in the device of the present invention.

A mechanical control member 41 which is S-shaped (FIGS. 1 to 3) or L-shaped (FIGS. 4 and 5) comprises a first arm 43 including a drive device 45 (e.g., a fork) for driving the retaining member 27 of the pin 23, and a second arm 47 that is advantageously orthogonal to the first arm and that has a first face including a projection 49 for sliding contact on the pipe 11, and that has an element 51 on an opposite face, preferably at its end, for being engaged by the finger 53 of the user, e.g., a rounded finger-receiving edge, thereby enabling the user to press on the mechanical control member 41. In FIG. 4, a second embodiment of a control member 41A is depicted wherein parts thereof corresponding to the member 41 have the same numerals, with a suffice "A". In FIG. 5, a third embodiment of a control member 41B is depicted wherein the numerals have the suffix B. In the embodiment of FIG. 4, the projection 49A is generally part-spherical in shape whereas in the embodiment of FIG. 5, the projection 49B is part-cylindrical in shape and extends across the width of the member 41B. In FIG. 1, means 55 provides for pivoting of the mechanical control member 41 about an axis that is perpendicular to the plane of the S-shape or of the L-shape are advantageously provided where the first arm 43 joins the second arm 47. The means 55 may be constituted by an opening for receiving a shaft, or on the contrary by studs forming a stub axle.

In a variant embodiment enabling individual measured quantities of substance to be dispensed, actuation of the valve (or preferably of the pump) and opening of the pin 23 that closes the dispensing orifice 29 do not take place simultaneously. In a first stage, the space left empty inside the chamber 21 mainly by the reduced diameter rod 33 of the pin 23 is filled, after which the shutter is opened and the desired quantity of substance is delivered. The quantity measured out is determined by the volume of the empty space in the chamber 21 and at the design stage of the device of the present invention, it can be adjusted to a desired value by determining the capacity of the chamber 21 and the fraction of its volume that is occupied by the pin 23. For example, the measured quantity can be increased by reducing the diameter of the rod 33.

The opening 29 constituting the dispensing orifice is adapted to the kind of substance to be dispensed (gel, foam, atomized droplets) and also to the type of dispensing intended by the manufacturer. The dispensing orifice may be constituted simply by a hole, e.g., a cylindrical hole formed through a wall. In the example shown in FIGS. 1 to 4, the dispensing orifice is a hole formed in the frustoconical end of the chamber 21. Similarly, the hole could be formed in a long thin end of the chamber 21 (not shown) to facilitate dispensing the substance into awkwardly-accessible nooks.

In FIG. 6, there can be seen an alternate embodiment of a pipe 11A, the parts of which have the same numerals as in FIG. 1, with the suffix "A". The pipe 11A includes means 57A for temporarily engaging a cannula 59 (FIG. 7), an injection needle 61 (FIG. 8), or a filter (not shown). Cannulas 59 or injection needles 61 may be discarded after a single use. The means 57A may comprise, for example, a tapering nose onto which the cannula 59 or injection needle 61 can be secured as a press fit.

As can be seen in FIG. 9, sealing at the dispensing orifice 29 may advantageously be improved by disposing a gasket 63 at the end of the tip 31, the gasket may be made of elastomer and it may be cylindrical or conical in shape. Similarly, sealing can be improved at the opening 25 of the chamber 21 by providing the piston 35 or the neck 37 with a gasket, e.g., a sealing ring (not shown).

FIG. 10 shows a single device of the invention receiving a plurality of aerosol cartridges 17.1, . . . , 17.i, . . . , 17.n (where n is equal to 2 in the example shown), for the purpose of containing a plurality of substances suitable for mixing and/or dispensing simultaneously. To cause the substances to mix outside the device of the invention, in the air or on an application surface, the orifices 29 of the various pipes 11 point in substantially the same direction. For example, the chambers 21 of all of the pipes 11 may have axes that are parallel or that converge slightly. The device of the invention as shown in FIG. 10 makes it possible, for example, simultaneously to dispense a resin (aerosol receptacle 17.1) together with its hardener (aerosol receptacle 17.2). Naturally, the ambit of the present invention extends to cases where n is equal to 2, 3, 4, 5, 6, or more.

The operation of the embodiment of the invention shown in FIGS. 1 and 2 is explained below.

As shown in FIG. 1, the pin 23 closes the dispensing orifice 29 in a sealed manner, with the valve 15 also being closed. When, as shown in FIG. 2, the user presses a finger 53 on the element 51, firstly the projection 49 bears against the pipe 11 in the direction of arrow 65, thereby lowering the pipe 11 which presses in turn on the valve 15 so as to open it, and secondly the member 41 pivots (see arrow 67) about the axis 55, thereby causing the fork 45 to pull on the ball 39 in the direction of arrow 69, thereby displacing the pin 23 which opens the dispensing orifice 29 so as to allow the substance 71 to be dispensed, e.g., in the form of atomized droplets. Once the desired spraying has been performed, the user releases pressure of the finger 53 on the mechanical control member 41 which rises in the opposite direction to arrow 65 under drive from the return member of the valve 15, e.g., a spring 73. As it rises, the control member 41 rotates about the axis 55 in the opposite direction to arrow 67 and the fork 45 pushes against the shoulder formed by the piston 35 in the neck 37 in the direction opposite to the arrow 69, thereby moving the pin 23 in translation and thus shutting the orifice 29. The dispenser returns to the position shown in FIG. 1. The residual substance contained in the duct 14 outside the valve 15 and in the pipe 11 is isolated and confined, and is thus protected against damage, in particular against polymerization, drying, or microbial or chemical contamination from the ambient medium.

Advantageously, the cap 18 includes a breakable element 75 that guarantees the substance has not been tampered with by preventing translation of the pin 23 until the arm 47 is actuated by a user, whereupon the pin 23 can break the element 75 (see FIG. 2). The consumer must then remove the breakable element in order to be able to use the aerosol dispenser of the present invention.

The cap may include decorative elements, e.g., a long skirt covering the pressurized receptacles), at least in part.

The invention is naturally not limited to the examples illustrated and described that are given purely by way of indication, and on the contrary it extends to any device enabling the orifice for dispensing the substance to be opened and a valve or a pump for dispensing substance to be actuated either simultaneously or else alternately (for measuring out purposes). In particular, it is possible to use pipes 11 that are rigid and not bent, and with or without openings 25 or external pins for the substance dispensing orifice 29, but without going beyond the ambit of the present invention.

In a preferred embodiment shown in FIG. 11 and taking advantage of the resilience of plastics material, the control member is in the form of a part 77 which is hinged about an axis 175 secured to the cap and situated at the front substantially over the end 29. The shutter piston 35 has a lip seal integrally molded therewith. The part 77 has a rear bearing region 78 that is more ergonomic than before. The part 77 and the cap constitute a single, integrally-molded piece. The part 77 has a region 79 for bearing against the rear portion of the pipe 11. By pressing on the rear bearing region 78, the part 77 is caused to pivot about the axis 175 while rearwardly bending the fork 80 disposed at the end opposite to the end 29, thereby reversing the pin 23 as shown in broken lines in FIG. 11. This variant is also applicable to multichannel versions and to metering (measuring out) versions.

The present invention is particularly suitable for substances in the form of gases, liquids, or semi-solids packaged in receptacles, in particular discardable receptacles of the aerosol type or of the type having a pump.

The present invention is mainly applicable to packaging foodstuffs, cosmetics, pharmaceuticals (human and veterinary), lubricants, paints, sealants, and/or adhesives.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed:

1. A dispenser assembly connected to a receptacle for discharging a substance contained in the receptacle, the dispenser assembly comprising:

a support member adapted to be mounted to a receptacle;

a dispensing head mounted to the support member for movement relative thereto and including an internal conduit having an inlet end adapted to be connected to an actuator of the receptacle for supplying the substance to the conduit, the conduit forming a dispensing orifice for discharging the substance;

a shutter mounted to the dispensing head for movement relative thereto between an orifice-opening position and an orifice-closing position; and a manually actuable control member mounted on the support member for movement relative thereto and being operably connected to the shutter and the dispensing head and movable from a rest position to an operating position for moving the shutter to its orifice-opening position and substantially simultaneously moving the dispensing head for actuating the actuator of the receptacle;

wherein the conduit includes a chamber having a narrowed portion forming the orifice; the shutter comprising a pin slidably movable within the chamber toward and away from the orifice between the orifice-opening and orifice-closing positions.

2. The dispenser according to claim 1, wherein the dispenser head is vertically slidably movable in the support member, and the control member is pivotably mounted to the support member.

3. The dispenser according to claim 2, wherein the control member is pivotable about an axis and includes a first portion for pressing downwardly on the dispensing head and a second portion for sliding the shutter.

4. The dispenser according to claim 1, wherein the support member forms an outwardly open recess, the control member being disposed in the recess.

5. The dispenser according to claim 1, wherein the control member is of one-piece Construction with the support member.

6. The dispenser according to claim 1, wherein the dispensing head is generally T-shaped, comprising a horizontal portion in which the orifice is disposed, and a downward portion comprising the inlet end for connection with an actuator of a receptacle.

7. The dispenser according to claim 6, wherein the control member is pivotable about an axis and includes a first limb forming a fork engaging an end of the pin remote from the orifice, and a second limb comprised of a downward projection slidably bearing against the dispensing head, the fork and projection being disposed on opposite sides of the axis, the control member further including a manually engageable surface disposed on the same side of the axis as the projection.

8. The dispenser according to claim 7, wherein the control member is generally S-shaped.

9. The dispenser according to claim 7, wherein the control member is generally L-shaped.

10. The dispenser according to claim 1, further including a cannula removably connected to the orifice.

11. The dispenser according to claim 1, further including a filter removably connected to the orifice.

12. The dispenser according to claim 1, further including an injection needle removably connected to the orifice.

13. The dispenser according to claim 1, wherein the dispenser head includes two of the conduits arranged to provide separate discharge orifices and adapted for connection to actuators of respective receptacles, a shutter disposed in each conduit, the control member being operably connected to both shutters for discharging substances from both orifices simultaneously.

14. The dispenser according to claim 1, wherein the support member comprises a cap for the receptacle, the control member comprising a lever formed of one piece with the cap and being pivotable relative to the cap about an axis situated over the dispensing orifice; the lever being flexible to bend during pivoting to cause the shutter to be moved to its orifice-opening position.

15. A dispenser comprising:

a receptacle for containing a substance to be dispensed, and an actuator for releasing the substance, the actuator being biased by a spring to a rest position and being movable to a substance-releasing position;

a dispensing head mounted on the receptacle for movement relative thereto and including an internal conduit communicating with said actuator, said conduit forming a dispensing orifice;

a shutter mounted to the dispensing head for movement relative thereto between an orifice-opening position and an orifice-closing position; and a manually actuable control member mounted on the receptacle and operably connected to the shutter and actuator, the control member being movable relative to the receptacle from a rest position to a dispensing position for moving the shutter to its orifice-opening position and simultaneously moving the actuator to its substance-releasing position, the control member being biased to its rest position by the spring which biases the actuator to its rest position;

wherein the conduit includes a chamber having a narrowed portion forming the orifice; the shutter comprising a pin slidably movable within the chamber toward and away from the orifice between the orifice-opening and orifice-closing positions.

16. The dispenser according to claim 15, wherein the control member is operably connected to the actuator through the dispenser head which is movable relative to the receptacle by the control member and is connected to the actuator.

17. The dispenser according to claim 15, wherein the control member is pivotable about an axis and includes a first portion for pressing downwardly on the dispensing head and a second portion for sliding the shutter.

18. The dispenser according to claim 15, further including a support member mounted to the receptacle, the dispensing head and control member being mounted to the support member for movement relative thereto.

19. The dispenser according to claim 15, wherein the substance is pressurized, and the actuator comprises a valve.

20. The dispenser according to claim 15, wherein the substance is non-pressurized, and the actuator comprises a pump.

* * * * *